350-407 SR

OR 4,017,154

X 4046E

United States

Kobayashi

[11] 4,017,154

[45] Apr. 12, 1977

[54] DISPLAY DEVICE

[75] Inventor: Masanori Kobayashi, Yachiyo, Japan

[73] Assignee: Kabushiki Kaisha Seikosha, Japan

[22] Filed: Dec. 23, 1974

[21] Appl. No.: 535,208

[30] Foreign Application Priority Data

| | | |
|---|---|---|
| Dec. 25, 1973 | Japan | 49-3930 |
| July 8, 1974 | Japan | 49-80430[U] |
| July 24, 1974 | Japan | 49-84755 |
| Sept. 13, 1974 | Japan | 49-105782 |
| Sept. 9, 1974 | Japan | 49-103598 |
| Sept. 13, 1974 | Japan | 49-105783 |

[52] U.S. Cl. ..... 350/159; 58/127 R; 340/336

[51] Int. Cl.[2] ..... G04B 19/06

[58] Field of Search ..... 340/336, 366; 40/28 C; 350/159; 58/50 R, 127 R

[56] References Cited

UNITED STATES PATENTS

| | | | |
|---|---|---|---|
| 3,096,594 | 7/1963 | Skrobisch | 40/28 C |
| 3,266,033 | 8/1966 | Frohbach | 350/159 |
| 3,560,966 | 2/1971 | Deshler et al. | 340/366 R |
| 3,874,163 | 4/1975 | Ikeno | 58/50 R |

FOREIGN PATENTS OR APPLICATIONS

| | | | |
|---|---|---|---|
| 1,460,598 | 12/1966 | France | 330/40 |

*Primary Examiner*—John K. Corbin
*Assistant Examiner*—R. A. Rosenberger
*Attorney, Agent, or Firm*—Robert E. Burns; Emmanuel J. Lobato; Bruce L. Adams

[57] ABSTRACT

A display device having a plurality of segment light polarizers for receiving incident light thereon and rotatable independently to jointly define sequentially different numerals in dependence upon their relative angular orientation. A common light polarizer is mounted sandwiched between two transparent plates forwardly of the light polarizer for polarizing light from the segment light polarizers and for viewing of the different numerals upon relative angular orientation of the segment light polarizers and relative angular orientation to the common light polarizer. The light polarizers are driven rotationally independently in timed relationship. A mask between the two transparent plates has openings therethrough positioned for viewing the numerals.

2 Claims, 51 Drawing Figures

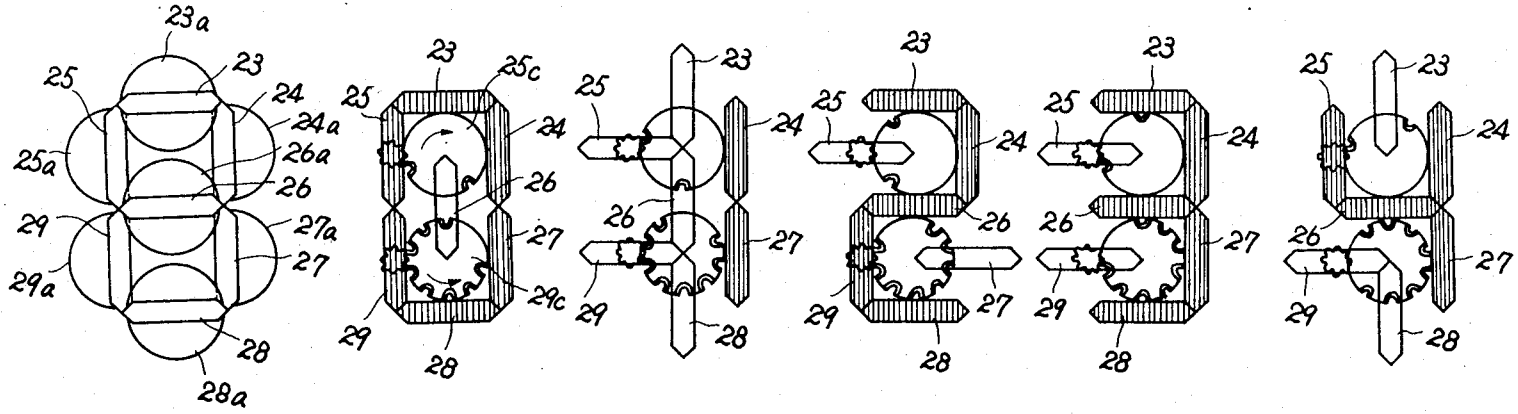
FIG.4
FIG.5A
FIG.5B
FIG.5C
FIG.5D
FIG.5E
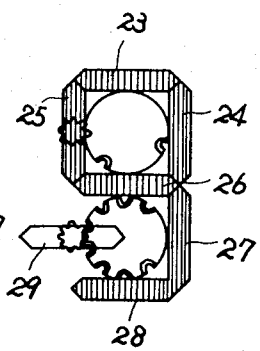
FIG.5J
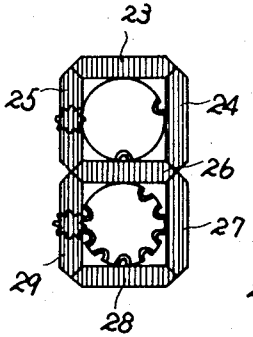
FIG.5I
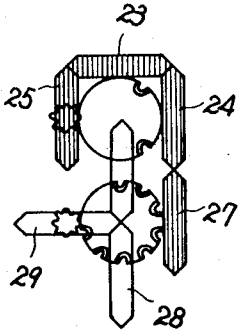
FIG.5H
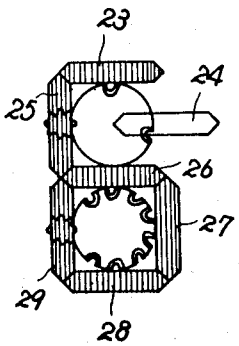
FIG.5G
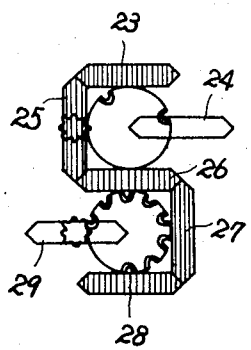
FIG.5F FIG.6
| NUM / SEG. | 0 | 1 | 2 | 3 | 4 | 5 | 6 | 7 | 8 | 9 |
|---|---|---|---|---|---|---|---|---|---|---|
| 23 | 1 | 1 | 0 | 1 | 1 | 0 | 0 | 0 | 0 | 0 |
| 24 | 0 | 0 | 0 | 0 | 1 | 1 | 1 | 0 | 0 | 0 |
| 25 | 1 | 0 | 0 | 1 | 0 | 0 | 0 | 0 | 0 | 0 |
| 26 | 0 | 1 | 0 | 0 | 0 | 0 | 1 | 1 | 0 | 1 |
| 27 | 0 | 1 | 1 | 0 | 0 | 0 | 0 | 0 | 0 | 0 |
| 28 | 1 | 1 | 0 | 1 | 1 | 0 | 1 | 1 | 0 | 0 |
| 29 | 1 | 1 | 1 | 0 | 0 | 1 | 1 | 1 | 1 | 1 |
FIG.8
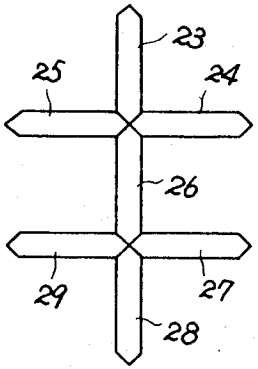
FIG.9A
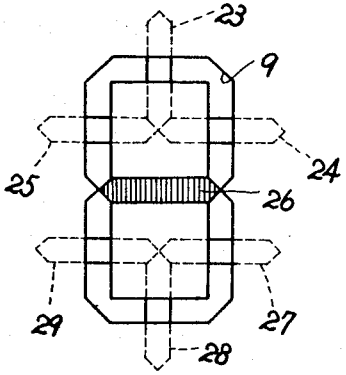
FIG.9B
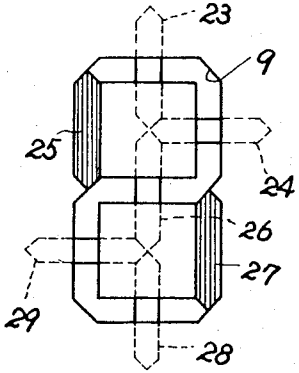
FIG.7
| NUM / SEG. | 0 | 1 | 2 | 3 | 4 | 5 |
|---|---|---|---|---|---|---|
| 30 | 1 | 1 | 0 | 1 | 1 | 0 |
| 31 | 0 | 0 | 0 | 0 | 1 | 1 |
| 32 | 1 | 0 | 0 | 1 | 0 | 0 |
| 33 | 0 | 1 | 0 | 0 | 0 | 1 |
| 34 | 0 | 1 | 1 | 0 | 0 | 0 |
| 35 | 1 | 1 | 0 | 1 | 1 | 0 |
| 36 | 1 | 1 | 1 | 0 | 0 | 1 |

301
301a
302
303
304
305
306
307
307a

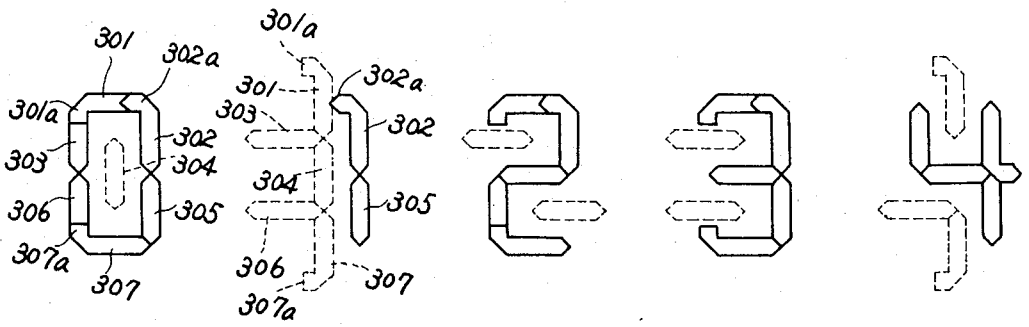
FIG. 21A
FIG. 21B
FIG. 21C
FIG. 21D
FIG. 21E
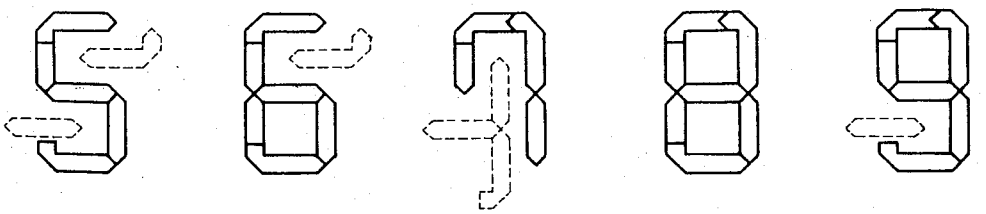
FIG. 21F
FIG. 21G
FIG. 21H
FIG. 21I
FIG. 21J

DISPLAY DEVICE

BACKGROUND OF THE INVENTION

The present invention relates to a display device for displaying numerals of a timepiece or the like using a polarizer.

Heretofore, timepiece display devices of the drum type or leaf type digital display devices are known. However such conventional devices have a defect in that the display drum or leaves carrying drum takes much space, the displayed characters are small in comparison to the display surface and the structure thereof is complex.

Further conventional electrically controlled digital display devices employing a luminous diode or a liquid crystal cell are expensive.

SUMMARY OF THE INVENTION

The present invention intends to eliminate the above described defects and to provide a new display device using a polarizer.

According to a feature of the present invention, there is provided a display device comprising a polarizer provided in front and segment polarizers provided at the back of said polarizer in a individually rotatable manner.

One object of the present invention is to provide a display device which is thin in thickness and the displayed character of which covers a wide space relative to the display surface.

Another object of the present invention is to control the rotation of the segment polarizer by the cams secured to the corresponding rotary shafts.

Another object of the present invention is to get the undisplayed segment polarizer invisible.

Another object of the present invention is to control the rotation of the segment polarizers by magnets secured to rotary shaft of the segment polarizers and drive magnets to perform quiet and steady rotation.

Another object of the present invention is to control the rotation of the segment polarizers by magnets secured to the rotary shaft of the segment polarizers and electromagnetic devices.

Another object of the present invention is to improve the shapes of the segment polarizers to effect clear character display

BRIEF DESCRIPTION OF THE DRAWINGS

These objects other objects and characteristic features of the present invention will become evident and will be more readily understood from the following description and claims taken in conjunction with the accompanying drawings, in which, FIG. 4 is a diagram illustrating an arrangement of segment polarizers, FIGS. 5A to 5J are explanatory views of character display, FIG. 6 is a table showing minutes display operation, FIG. 7 is a table showing tens of minutes display operation, FIG. 8 shows another example of arrangement of segment polarizers, FIGS. 9A and 9B are explanatory views of character display, FIG. 21A to 21J show displayed numerals by further segment polarizers.

DESCRIPTION OF THE PREFERRED EMBODIMENTS

Figures 1, 2, 3:
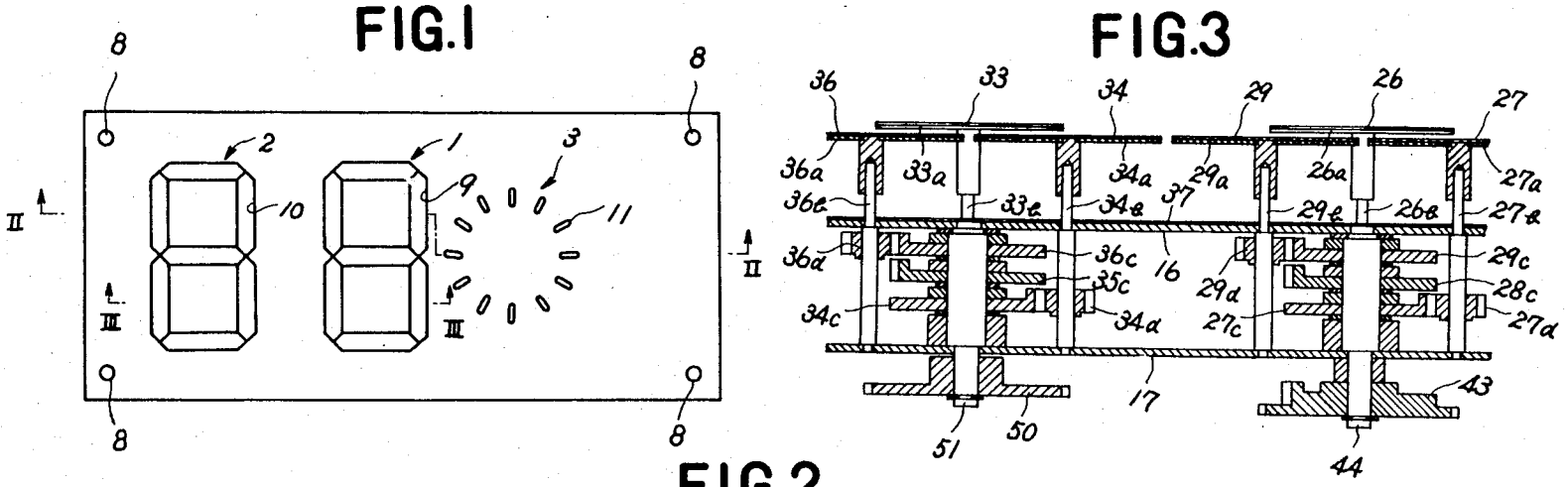
FIG. 1 is an elevational view of an embodiment according to the present invention.
FIG. 2 is an enlarged sectional view along section lines II — II in FIG. 1.
FIG. 3 is an enlarged sectional view along section lines III — III in FIG. 1, partly broken away.
Figure 12:
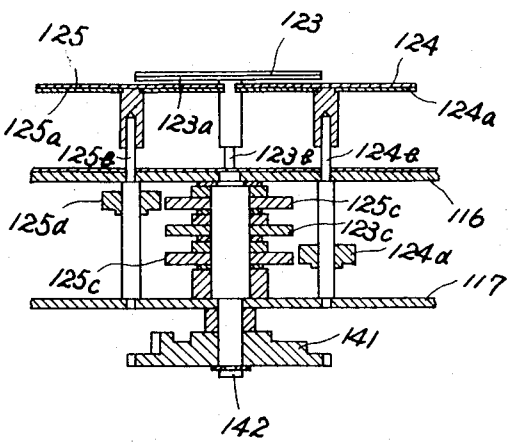
FIG. 12 is a sectional view of essential part of another embodiment.
Figure 11:
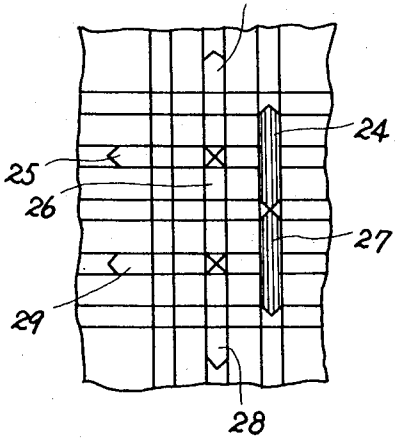
FIG. 11 is an explanatory view of character display employing the backboard of FIG. 10.

Referring to FIG. 1, the display device is provided minutes display means 1, tens of minutes display means 2, and seconds display means 3. Details of these means are to be explained referring to FIGS. 2 to 4. A mask 5 and a polarizer 6 are held between two transparent plates 7, 7 such as acrylic glass and they are secured to a case 4 by means of four pillars 8—. In the mask 5, a hole 9 for minutes display, a hole 10 for tens of minutes display and holes 11 for seconds display are provided. The polarizing direction of the polarizer 6 is transverse in FIG. 1. First, the seconds display means 3 will be explained. In the mask 5, twelve holes 11 are provided radially and in the polarizer 6, corresponding twelve holes 12 are provided. A second display disk 14 secured to a second arbor 13 is provided with one hole 15. The second arbor 13 is rotatably supported by a middle plate 16 and a base plate 17. A drive pinion 19 of a motor 18 engages reduction gear wheel 20, which engages a gear wheel 21 secured to the second arbor 13. The second arbor 13 rotates once every sixty seconds. An illuminant 22 such as fluorescent lamp or blacklight lamp is secured to the middle plate 16. When the hole 15 in the second display disk 14 coincides with one hole 12 in the polarizer, the light from the illuminant 22 comes through the holes so as to display seconds. Regarding the minutes display means 1, seven segment polarizers 23 ~ 29 are arranged as shown in FIG. 4, and they are respectively secured to rotary wheels 23*a* ~ 29*a* which are connected to rotary shafts 23*b* ~ 29*b*. These shafts 23*b* ~ 29*b* are rotatably supported by the middle plate 16 and the base plate 17. The tens of minutes display means 2 is substantially the same as the minutes display means 1. Segment polarizers 30 ~ 36 are respectively secured to rotary wheels 30*a* ~ 36*a*. The wheels 30*a* ~ 36*a* are respectively connected to rotary shafts 30*b* ~ 36*b*. A background 37 is secured to the front surface of the middle plate 16.

The driving mechanism of these display means will be hereafter explained. A second gear wheel 38 is connected at the end portion of the second arbor 13. Since the second gear wheel 38 is provided with one tooth, the intermediate gear wheel 40 is rotated intermittently by 36° every 1 minute. Ten minutes wheel 41 engages with the intermediate gear wheel 40 and is also rotated by 36° every 1 minutes. To the shaft 42 of the ten minutes wheel 41 are connected four cams 23*c*, 24*c*, 25*c*, 26*c* which respectively engage with pinions 23*d*, 24*d*, 25*d*, 26*d* secured to the rotary shafts 23*b* ~ 26*b*. The ten minutes wheel 41 engages with a follow wheel 43 of the same type. The follow wheel 43 also rotates by 36° a minutes. To a shaft 44 of the follow wheel 43, three cams 27*c*, 28*c*, 29*c* are connected. These cams 27*c*, 28*c*, 29*c* respectively engage with pinions 27*d*, 28*d*, 29*d* connected to the rotary shafts 27*b*, 28*b*, 29*b*. The rotation of the 10 minutes wheel 41 is transmitted to 60-minutes wheel 48 through gear wheels 45, 46, 47. The 60-minutes wheel 48 rotates intermittently by 60° every 10 minutes. Four cams 30*c* ~ 33*c* are secured to a shaft 49 of the 60-minutes wheel 48. These cams 30*c* ~ 33*c* respectively engage with pinions 30*d* ~ 33*d* secured to the rotary shafts 30*b* ~ 35*b*. A follow wheel 50 engaging the 60-minutes wheel 48 also rotates once every sixty minutes. Three cams 34*c*, 35*c*, 36*c* are connected to a shaft 51 of the follow wheel 50. These cams 34*c*, 35*c*, 36*c* respectively engage with pinions 34*d*, 35*d*, 36*d* which are connected to the rotary shafts 34*b*, 35*b*, 36*b*.

Numeral display operation by the segment polarizers will be explained. First, the minutes display operation will be explained. Polarizing direction of the segment polarizer 23 ~ 29 is vertical when they are arranged as shown in FIG. 4. Referring to FIG. 5A, numeral 0 is displayed. The polarizing direction of the segment polarizers 23, 24, 25, 27, 28, 29 differ from that of the polarizer 6 by 90°. Therefore the light from the illuminant 22 passed through the segment polarizers 23, 24, 25, 28, 29 is intercepted by the polarizer 6. Thus the portions looks dark or black. On the other hand, the polarizing direction of the segment polarizer 26 accord with that of the polarizer 6 and the portion looks bright. Thus numeral 0 is displayed in black on a bright ground. After one minute, the ten minutes wheel 41 and the follow wheel 43 rotate by 36° and the cams 23*c* ~ 29*c* secured to the shafts 42, 44 also rotate by the same degrees. The cams 23*c*, 25*c*, 28*c*, 29*c* respectively engage with pinions 23*d*, 25*d*, 28*d*, 29*d* and turn them by 90°. The other cams 24*c*, 26*c*, 27*c* do not engage with the corresponding pinions 24*d*, 26*d*, 27*d* and do not turn them. Accordingly, only the segment polarizers 23, 25, 28, 29 turn by 90°. The segment polarizer 24, 27 differ from the polarizer 6 in polarizing direction by 90° to show numeral 1 as shown in FIG. 5B. One more minute later, the segment polarizers 23, 26, 27, 28, 29 are turned by 90°, and the segment polarizers 23, 24, 26, 28, 29 become different from the polarizer 6 in polarizing direction by 90° to show numeral 2. The displayed numerals from 3 to 9 are respectively shown in FIGS. 5D to 5J. Turn operations of the segment polarizers 23 ~ 29 are shown in FIG. 6 by a table. In the table, left column shows segment polarizers 23 ~ 29 and the numerals from 0 to 9 are shown in the upper row. In the table, "1" means turn of the segment polarizers by 90°, and "0" means no turn. For example, the segment polarizer 23 turns by 90° when the displayed numeral changes from 0 to 1, 1 to 2, 3 to 4 and 4 to 5.

Regarding tens of minutes display operation, the 60-minutes wheel 48 and the follow wheel 50 turns 60° every ten minutes. The cams 30*c* ~ 36*c* respectively engage with the corresponding pinions 30*d* ~ 36*d* to turn the segment polarizers 30 ~ 36. The numeral display operation by the segment polarizers 30 ~ 36 is similar to the minutes display operation. The operation of the segment polarizers is shown in FIG. 7 by a table.

In the above embodiment, numerals are displayed black on bright ground, however numerals may be displayed bright on dark ground. In the latter case, black coloured mask 5 is used and the segment polarizers 23 ~ 29 and 30 ~ 36 are arranged in the position turned by 90° from the former case of FIG. 4. For example the segment polarizers 23 ~ 29 are arranged as shown in FIG. 8. To show numeral 0 the segment polarizer 26 turns by 90° and its polarizing direction differs from that of the polarizer by 90° to intercept light. The polarizing direction of other segment polarizers 23, 24, 25, 28, 29 accords with that of the polarizer 6 to pass light. Thus numeral 0 is displayed bright in black mask ground. Numeral 2 is displayed as shown in FIG. 9B. The operation of the segment polarizer is the same as the former case shown in FIG. 6 and FIG. 7.

In the above embodiment, an illuminant 22 is employed as a light source, however outside light may be employed instead of the illuminant. In this case the mask 5 is unnecessary.

An improvement to display numerals more clearly will be explained.

When a segment polarizer is turned to an undisplayed position, it often happens that the outline or the shadow of the segment polarizer becomes visible. Especially in the reflective type display device outside light instead of illuminant, a transparent plate is provided in front to accept light from outside and outline or shadow of a segment polarizer becomes visible and display is not clear. First, a case in which numerals are displayed bright in black ground will be explained. In this case a black backboard 37 is employed. The blackboard may be painted black or a polarizer polarizing direction of which differs 90° from that of the polarizer 6 may be used as a backboard. The rotary wheels 23*a* — are made of bright opaque material, or reflective films may be provided between the rotary wheels and the segment polarizers 23—. With this structure, the displaying segments look bright and undisplayed segments becomes dark and indistinguishable from the black of the backboard 37.

To the contrary, to display in black colour in the bright ground, the backboard 37 is coloured brightly. But in this case, the undisplayed segment polarizers become visible faintly. To eliminate this defect, the rotary wheels 23*a* — are coloured a little brigher than the blackboard 37. Thus the mixed colour of the segment polarizer and the rotary wheel becomes equal to the colour of the backboard. Therefor the undisplayed segment polarizers are almost invisible.

Figure 10:
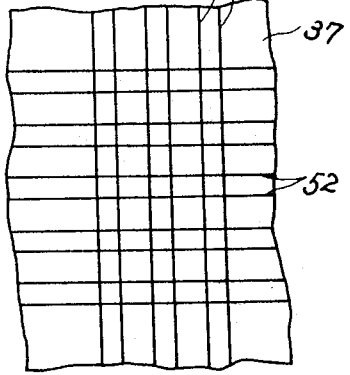
FIG. 10 is an elevational view of a backboard.

It is possible to get the outlines of segment polarizer indistictive by quite other way. Refering to FIG. 10, a plurality of pairs of lines 53 — perpendicularly intersecting one another are made on the backboard. The paired lines 52, 52 are spaced at the same distance as the width of the segment polarizer. These lines 52 — are so positioned that side lines of the segment polarizers may overlap them. For example, in display of mumeral 1, the side lines of the undisplayed segment polarizers 23, 25, 26, 28, 29 overlap the lines 52—. Therefore the undisplayed segment polarizers become almost unnoticeable.

Another embodiment of rotary drive mechanism of segment polarizers will be hereafter described.

In FIGS. 12 to 14B, the parts corresponding to the parts of the embodiment of FIGS. 1 to 7 are given the reference numerals increased by 100 except otherwise defined. In the present embodiment, drive wheels 123*c* — carrying thereon permanent magnets $m_1$, $m_2$ — are provided instead of the cams 23*c* — and cruciform wheels 123*d* — are provided instead of the pinions 23*d*—. The four poles of the each cruciform wheel 123*d* — are magnetized south and north alternately. Click means comprising click springs 153— and iron pieces 154— connected to the end portions of the springs 153 are provided adjacent and facing to the cruciform wheel 123*d*. The click means regulate rotations of the cruciform wheels 123*d*—.

Figure 14B:
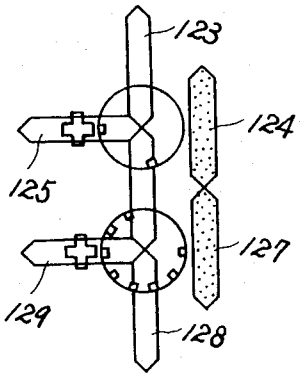
Figure 14A:
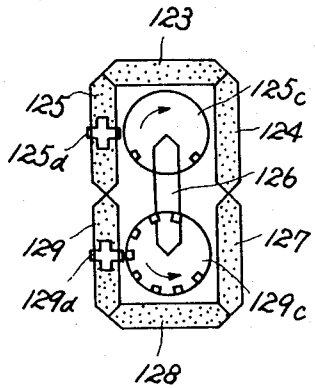
Figure 13B:
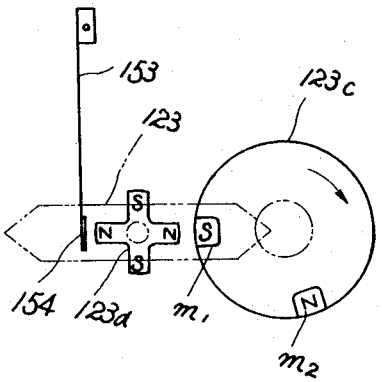
FIGS. 13A and 13B are explanatory view of the rotational drive mechanism of FIG. 12, FIGS. 14A and 14B are explanatory views of character display, FG. 15 is a sectional view of an essential part of another embodiment.
Figure 13A:
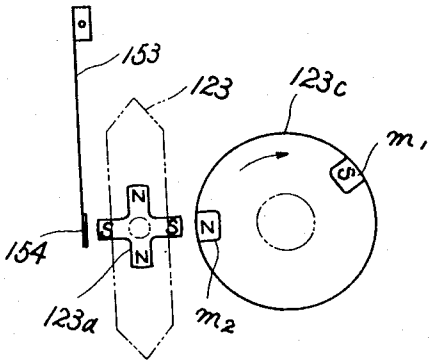

Operationally, the north pole $m_2$ of the drive wheel 123*c* faces to the south pole of the cruciform wheel 123*d* to orient the segment polarizer 123 vertically as shown in FIG. 13A. When the drive wheel 123*c* turns clockwise and the magnet $m_1$ approaches the position facing the cruciform wheel 123*d*, the south pole of the cruciform wheel 123*d* is repulsed and the north pole is attracted. As a result the cruciform wheel 123*d* is turned counterclockwise by 90° as shown in FIG. 13B. The segment polarizer 123 is oriented transversely. In this manner, as the drive wheels 123*c* — rotate predetermined angle, the cruciform wheels 123*d* — rotate by 90° to display numerals as shown in FIG. 14A, 14B. Numerals from 0 to 9 are displayed by segment polarizers in the same manner as the former embodiment.

Further another embodiment of rotary drive mechanism of segment polarizer will be explained referring to FIGS. 15 to 19.

Figure 16:
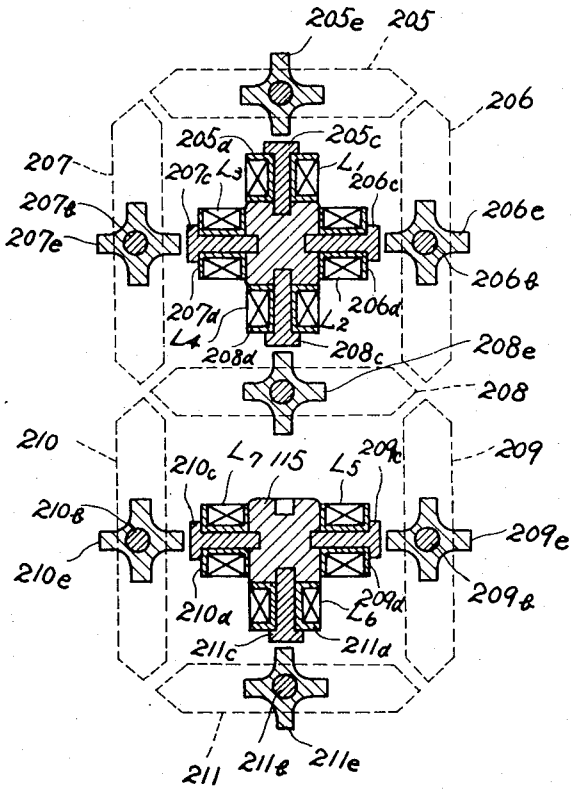
FIG. 16 is a sectional view along lines XVI — XVI in FIG. 15.
Figure 15:
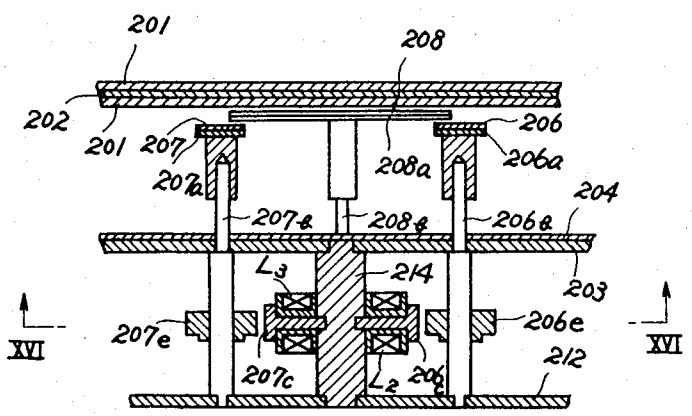

In the present embodiment characteristic features exists in that segment polarizers are diven electromagnetically without employment of a drive motor. In FIGS. 15 and 16, a polarizer 202 is held between transparent plates 201, 201 such as acrylic glass. On the front surface of the middle plate 203, a backboard 204 is connected. Seven segment polarizers 205, 206, 207, 208, 209, 210, 211 are respectively secured to the rotary plates 205*a* ~ 211*a* of the same shape. These rotary plates 205*a* ~ 211*a* are respectively connected to shafts 205*b* ~ 211*b*. The shafts 205*b* ~ 211*b* are rotatably supported by the middle plates 203 and the base plate 212. Two square pillars 214, 215 are fixed between and by the middle plate 203 and the base plate 212. The square pillar 214 is provided with four cores 205*c*, 206*c*, 207*c* and 208*c* on its four faces, and the square pillar 215 is provided with three cores 209*c*, 210*c*, 211*c* on its three faces. These cores 205*c* ~ 211*c* are inserted into the holes of bobbins 205*d* ~ 211*d*. Coils $L_1$ to $L_7$ are provided around the bobbins 205*d* ~ 211*d*. Cruciform wheels 205*e* 211*e* are respectively connected to the shafts 205*b* ~ 211*b*. These cruciform wheels 205*e* ~ 211*e* are respectively positioned adjacent and facing to the cores 205*c* ~ 211*c*. Four projections of each cruciform wheel are magnetized south and north alternately. Electric circuit for supplying current to the coils $L_1$ to $L_7$ will be explained referring to FIG. 17. Output power from a counter (not shown in the drawing) is supplied to a pulse distributor P. Reference characters $D_1$ to $D_{14}$ designate diodes, reference characters $R_1$, $R_2$ designate resistances, reference character $Tr_1$, $Tr_2$ designate transistors and reference character $E_1$, $E_2$ designates power source.

The polarizing direction of the front polarizer 202 is transverse and the polarizing direction of the segment polarizers 205 ~ 211 is vertical.

Figure 19:
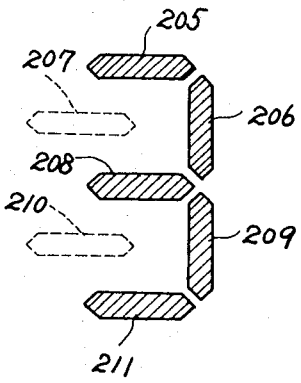
Figure 18:
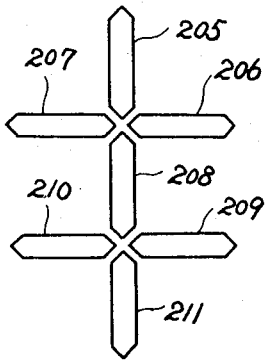
Figure 17:
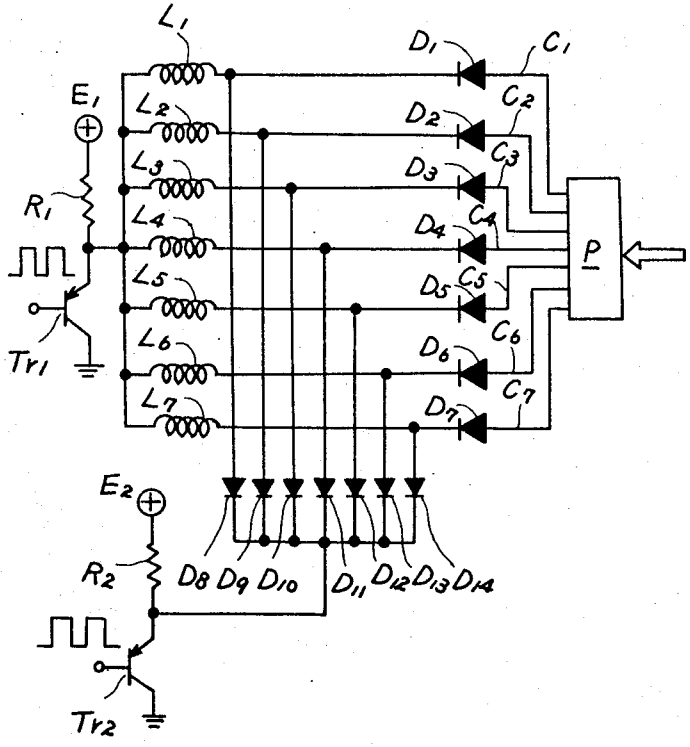
FIG. 17 is a circuit of the embodiment of FIG. 15, FIGS. 18 and 19 are explanatory views of operation of segment polarizers.
Figures 20A, 20B, 20C, 20D, 20E, 20F, 20G, 20H, 20I, 20J:
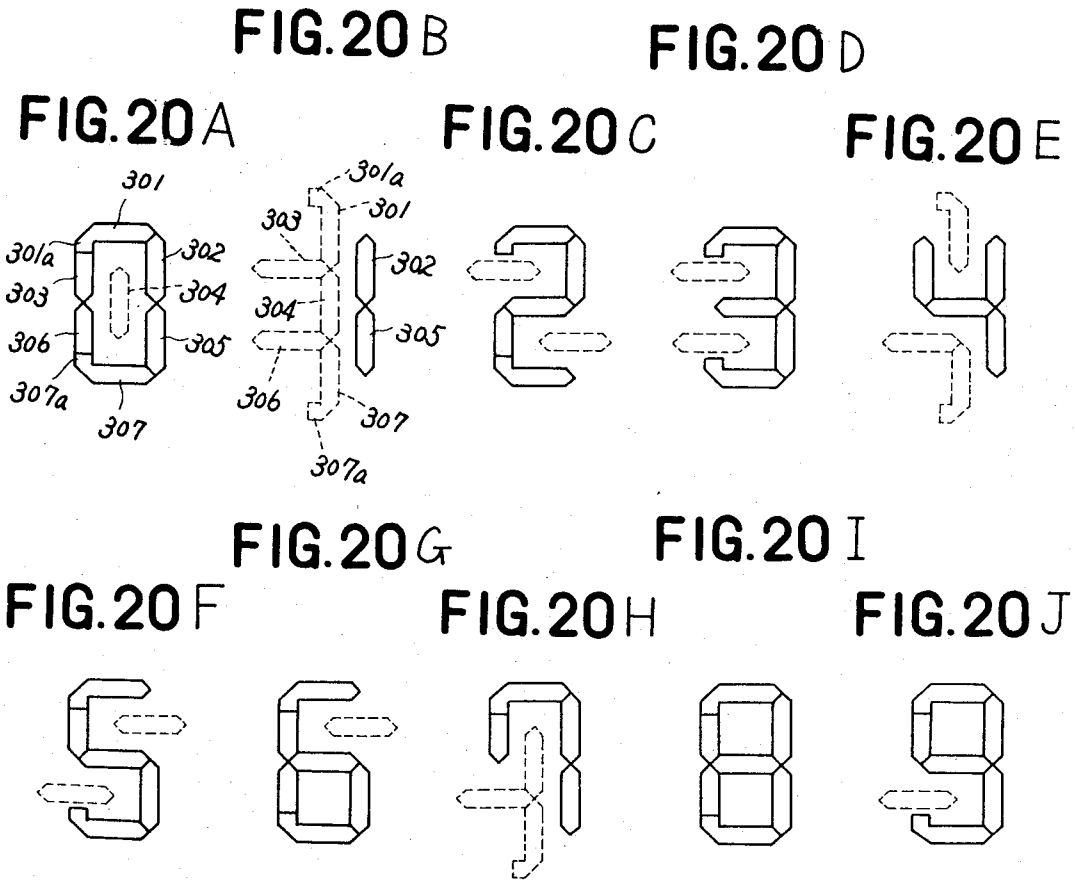
FIGS. 20A to 20J show display numerals by other segment polarizers.

Operationally, the segment polarizers 205 ~ 211 are reset to the state of FIG. 18 immediately before numeral display operation. This is an undisplayed state. The reset operation will be explained. A pulse signal is supplied to the base of the transistor $Tr_2$ immediately before a timing pulse is supplied to the base of the transistor $Tr_1$. As the transistor $Tr_2$ turns ON, electric current flows from the power source $E_1$ to the transistor $Tr_2$ through the coils $L_1$ ~ $L_7$ and the diode $D_9$ ~ $D_{14}$. The cores 205*c* ~ 211*c* are magnetized north. The north poles of the cruciform wheels 205*e* ~ 211*e* are repulsed and the south poles are faced to the cores. Thus the segment polarizers 205 ~ 211 direct as shown in FIG. 18. Then an instructive output signal to show numeral 3, for example, is supplied from the counter to the pulse distributor P. The pulse distributor P supplies output signals $C_1$, $C_2$, $C_4$, $C_5$ and $C_7$. Under this condition, a timing pulse that is an instructive pulse to change display is supplied to the base of the transistor $Tr_1$ to turn it ON. Thus magnetizing current flow in the coil $L_1$, $L_2$, $L_4$, $L_5$ and $L_7$ in the direction opposite to the case of reset operation. Therefore the cores 205*c*, 206*c*, 208*c*, 209*c* and 211*c* are magnetized south and the cruciform wheels 205*e*, 206*e*, 208*e*, 209*e* and 211*e* are repulsed and turned by 90°. Only the segment polarizers 205, 206, 208, 209 and 211 are turned to show numeral 3 as shown in FIG. 19. To display another numeral the segment polarizers are again reset, and then desired numeral is displayed.

Next, improvement in the shape of segment polarizer to get more natural display of numeral will be explained.

In the above embodiments, seven segment polarizers of the same shape are used. On the contrary in the present improvement, segment polarizers 301, 307 are provided with hooked portions 301*a*, 307*a*. With this improvement numerals 2, 3, 5 and 9 look more naturally as shown in FIGS. 20A to 20J. Further, incase the segment polarizer 302 is provided with hooked portion 302*a*, numerals 1 and 4 will become more naturally as shown in FIGS. 21A to 21J. It will be apparent from the drawings that these hooked portions do not obstruct when the segment polarizers display other numerals.

What is claimed is:

1. A display device comprising, a plurality of segment light polarizers mounted for receiving incident light thereon and for rotation independently and positioned to jointly define different numerals sequentially in dependence upon their relative angular orientation, a common light polarizer mounted forwardly of said plurality of segment light polarizers and common thereto for polarizing light from said segment light polarizers and for viewing of said different numerals thereon in dependence upon the relative angular orientation of the segment light polarizers and their relative angular orientation to said common light polarizer, driving means to drive the segment light polarizers rotationally independently in timed relationship to develop said different numerals sequentially in dependence upon relative angular positions thereof during rotation, two transparent plates between which said common light polarizer is sandwiched, a mask between said two transparent plates having openings therethrough positioned for viewing of the corresponding individual segments of said numerals on said common light polarizer, said openings being shaped to correspond in configuration with corresponding segment light polarizers, and said driving means positioning said corresponding segment light polarizers in registry with corresponding openings, whereby said numerals are sharply defined, said mask having other openings arranged circularly, angularly spaced, a disc spaced from said mask in said device and having an opening therethrough rotated into registry with said other openings, a light source for transmitting light through the opening in said disc, and means in said driving means for driving the last-mentioned disc in timed relationship with said segment light polarizers.

2. A display device comprising a plurality of segment light polarizers mounted for receiving incident light thereon and for rotation independently and positioned to jointly define different numerals sequentially in dependence upon their relative angular orientation, a common light polarizer mounted forwardly of said plurality of segment light polarizers and common thereto for polarizing light from said segment light polarizers and for viewing of said different numerals thereon in dependence upon the relative angular orientation of the segment light polarizers and their relative angular orientation to said common light polarizers, driving means to drive the segment light polarizers rotationally independently in timed relationship to develop said different numerals sequentially in dependence upon relative angular positions thereof during rotation, and means mounting the segment light polarizers for rotation independently comprising a plurality of opaque discs rotatably driven independently by said driving means.

* * * * *